United States Patent [19]

Kawaguchi et al.

[11] Patent Number: 4,790,764

[45] Date of Patent: Dec. 13, 1988

[54] ELECTRICAL POWER TERMINAL FOR CIRCUIT BOARDS

[75] Inventors: Akira Kawaguchi, Tachikawa; Takinori Sasaki, Hino, both of Japan

[73] Assignee: AMP Incorporated, Harrisburg, Pa.

[21] Appl. No.: 29,506

[22] PCT Filed: May 14, 1986

[86] PCT No.: PCT/US86/01045

§ 371 Date: Mar. 9, 1987

§ 102(e) Date: Mar. 9, 1987

[87] PCT Pub. No.: WO86/07201

PCT Pub. Date: Dec. 4, 1986

[30] Foreign Application Priority Data

May 24, 1985 [JP] Japan ..... 60-110632

[51] Int. Cl.[4] ..... H01R 9/09

[52] U.S. Cl. ..... 439/78; 439/746; 439/825

[58] Field of Search ..... 439/78–84, 439/746, 825

[56] References Cited

U.S. PATENT DOCUMENTS 4,186,982 2/1980 Cobaugh et al. ..... 339/17 C

FOREIGN PATENT DOCUMENTS 0054377 2/1981 European Pat. Off. .
2028631 9/1970 France .
305016 8/1967 Sweden ..... 439/59
2039691 8/1980 United Kingdom .

*Primary Examiner*—Neil Abrams
*Attorney, Agent, or Firm*—Bruce J. Wolstoncroft

[57] ABSTRACT

An electrical terminal for connecting a power supply section (35) to a circuit board (50) which requires no tools and utilizes minimal space on the circuit board (50). The terminal having mounting pins (14) which frictionally and electrically engage holes (30 in the circuit board (50) and a contact portion (18) which resiliently contact the power supply section (35), thereby effecting a positive electrical connection between the power supply section (35) and the circuit board (50).

16 Claims, 4 Drawing Sheets

ELECTRICAL POWER TERMINAL FOR CIRCUIT BOARDS

The present invention relates to an electrical terminal for interconnecting a circuit board with a power supply section, and more particularly to an electrical terminal which occupies minimal space and requires no tools for connection to the circuit board or the power supply.

Electrical terminals for transmitting current from a power supply section to circuit elements on a circuit board are known in the industry. The electrical terminal shown in FIG. 1 is one such terminal. The power supply is connected to the connector through the use of a screw requiring the use of tools for proper installation. This is particularly labor intensive when the circuit board has a large current capacity which requires a plurality of terminals, each of which must have the power supply individually secured by a screw. Further, this type of design occupies a relatively large area on the circuit board which causes problems when high density circuit elements are required. The contact pins cannot be arranged at equal intervals corresponding with the holes of the circuit board because the width of the terminal must be relatively large in order to allow for insertion of the screw and to provide for a flat power supply receiving surface having a width at least equal to the width of the power supply source. Consequently, the rows of contact pins must be spaced from each other more than an optimal amount.

The press-fit type contact pins used in terminals of this type are disclosed in U.S. Pat. No. 4,186,982. It is essential that the material of the contact pin have a thickness sufficient to withstand the large elastic force which is applied thereto. In order for easy manufacture of terminals using this contact pin, the thickness required for the contact pin must be maintained throughout the terminal. This can be done in devices such as the above-described electrical terminal which require hardware for installation. However, if the thick metal plate is bent to form a small diameter tubular male contact, eliminating the need for hardware, cracks are created on the tubular surface because of the small radius of curvature of the tubular portion. Consequently, the male contact cannot be used.

An object of the present invention is to provide a compact electrical terminal having a plurality of press-fit type contact pins at one end thereof and a contact portion engageable with a matable contact at the other end. The terminal may be easily manufactured and ensures reliable electrical connection while reducing the area needed by the terminal on the circuit board. The contact pins include a mounting portion which is resiliently press-fitted into the holes of the circuit board and fixed therein. The contact portion is provided with a noncylindrical contact section having a thickness identical with that of the contact pins. The contact portion is also provided with a resilient contact arm stamped and formed from a part of the contact portion. Lances are provided so that the terminals may be enclosed in a housing if necessary.

The invention will be described by way of example by reference to the drawings of which:

Figure 1:
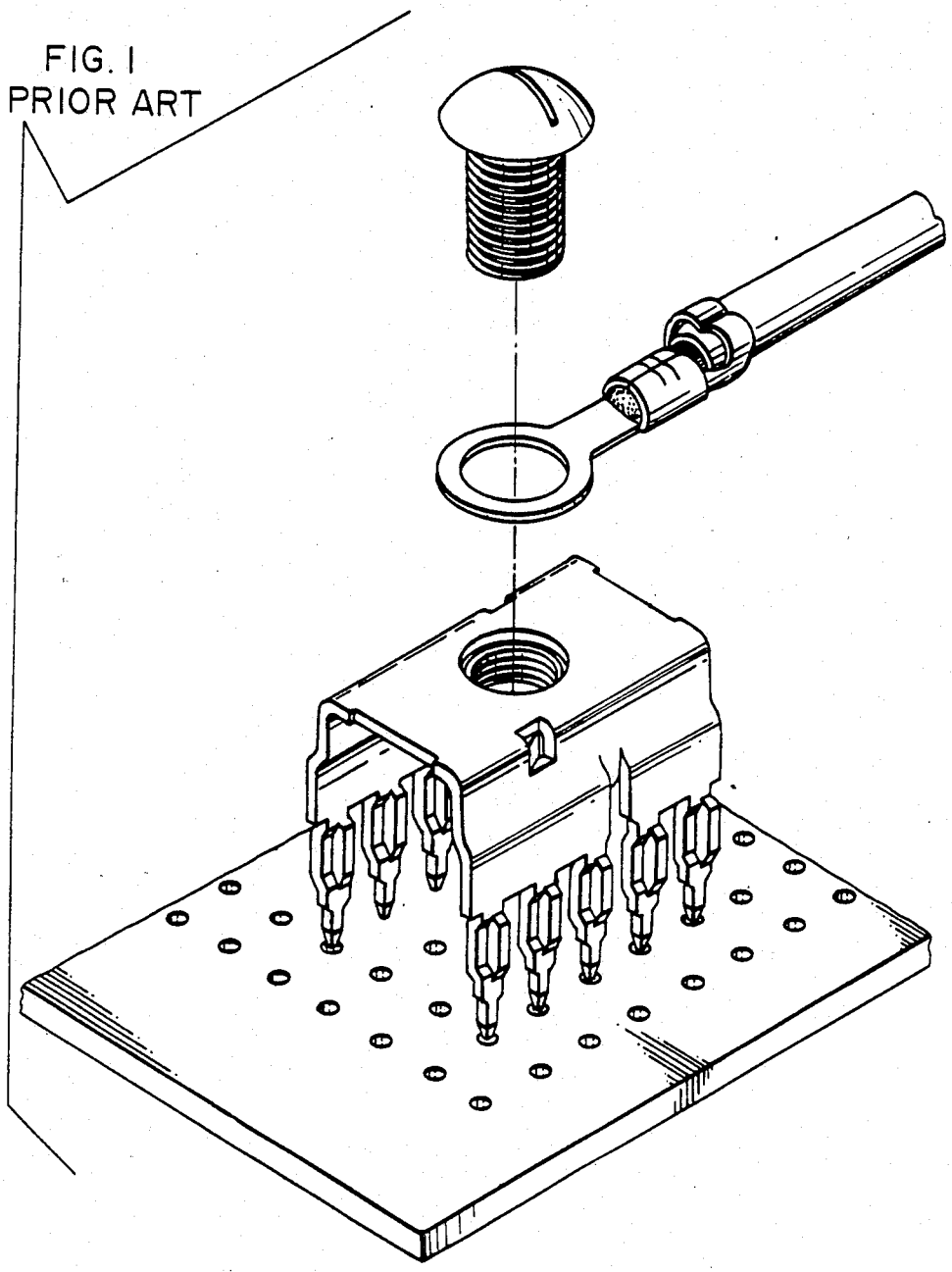
FIG. 1 PRIOR ART
FIG. 1 is an exploded perspective view of an electrical terminal as disclosed by the prior art.
Figure 2:
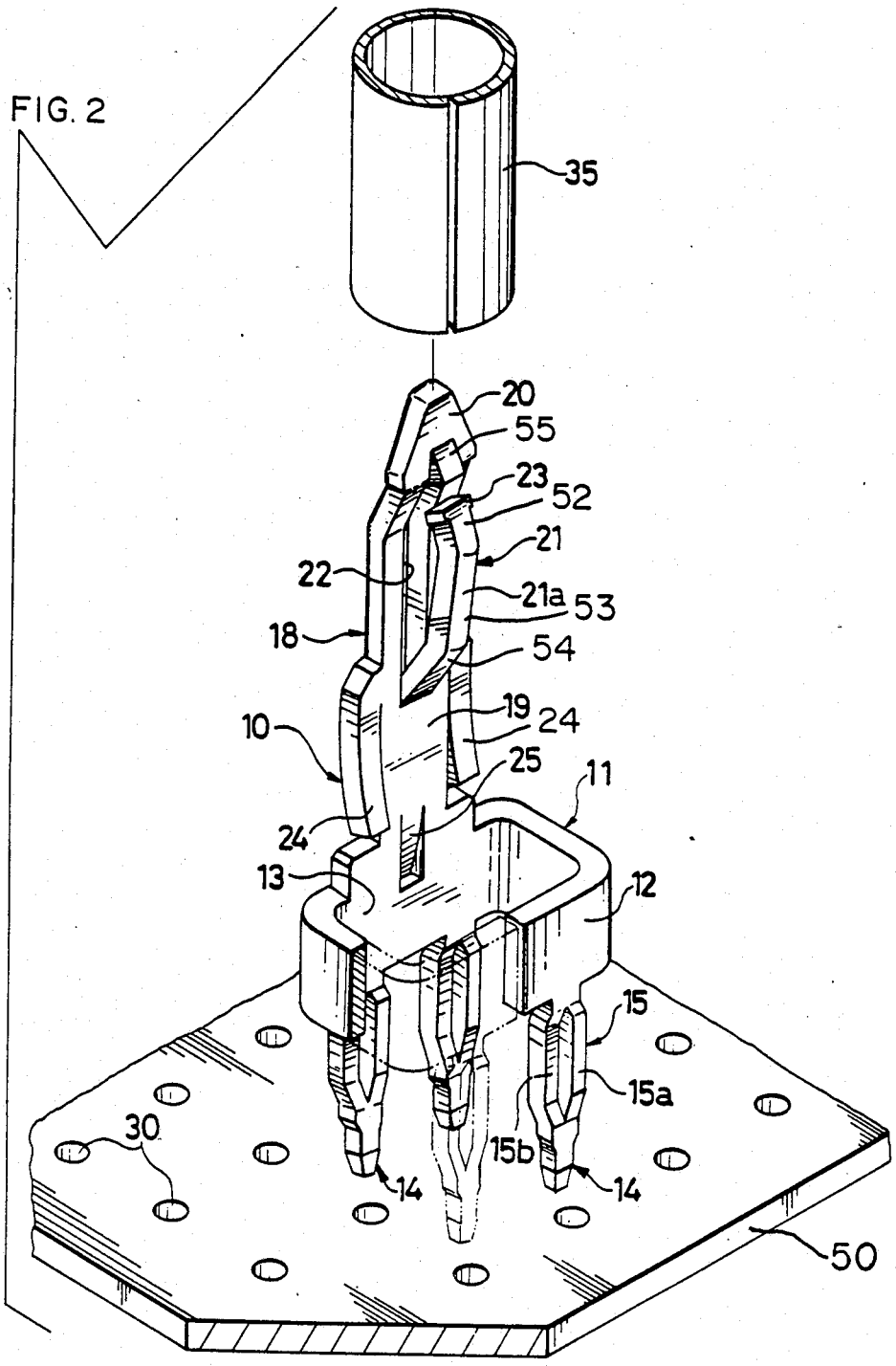
FIG. 2 is an exploded perspective view of an electrical power terminal of the present invention.

FIG. 2 shows an electrical power terminal 10 of the present invention which is stamped and formed from a metal sheet having desirable conductive and spring characteristics. Terminal 10 has a rectangular annular base 11 and a male contact section 18 extending from base 11.

Base 11 has a plurality of contact pins 14 which project downward from lower end surfaces of opposed walls 12 and 13. Contact pins 14 are spaced such that pins 14 correspond with the spacing of holes 30 provided on circuit board 50. Although terminal 10 shown in FIG. 2 has four contact pins 14, the number of pins 14 varies depending on the current to be transmitted to circuit board 50. The more current transmitted will require more contact pins 14 to accommodate the increased current. Contact pins 14 are of the type disclosed in U.S. Pat. No. 4,186,982, the disclosure of which is incorporated herein by reference.

Each contact pin 14 has a mounting portion 15 which is press-fitted in holes 30 of circuit board 50 and fixed therein as discussed below. Mounting portion 15 has at least two legs **15*a* and 15*b* which have resilient characteristics defining a compliant section. A lateral distance between outside walls of legs 15*a*, 15*b* is designed to be greater than the diameter of the holes 30 or circuit board 50**.

Figure 3:
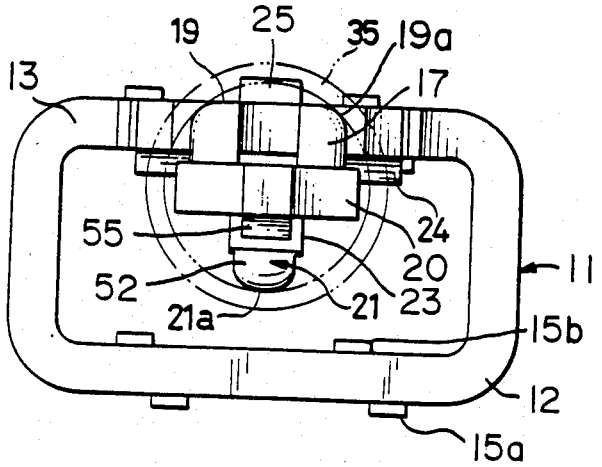
FIG. 3 is a top plan view of the terminal in engagement with a power supply section in phantom.

Male contact section 18 is integral with base 11 and extends upward from an upper end surface of wall portion 13 of base 11. Male contact section 18 is comprised of a vertical portion 19 extending from wall portion 13 of base 11, an inclined portion 17 extending from vertical portion 19 and an essentially triangular tip portion 20 extending from inclined portion 17. Vertical portion 19 extends in the same plane as wall portion 13. Vertical portion 19 has radiussed side edges **19*a*, as best shown in FIG. 3. Tip porton 20 extends from inclined portion 17 such that tip portion 20 is parallel to the plane encompassing vertical portion 19. A projection 55 is provided on tip portion 20 to allow a female contact section 35 to be easily inserted onto male section 18**, as discussed below.

An elongated resilient tongue 21 is stamped from contact section 18 and extends from a central area of vertical portion 19 to projection 55 on tip portion 20. Tongue 21 has a fixed end portion 54 attached to vertical portion 19, a center portion 53 attached to portion 54 and a free end portion 52 attached to portion 53. Tongue 21 is bent such that central portion 53 is essentially parallel to vertical portion 19. Fixed end portion 54 and free end portion 52 are inclined from central portion 54 toward vertical portion 19. A contact surface **21*a* is provided on central portion 53 and is arcuate to allow female contact section 35 to be easily inserted onto male section 18, as will be discussed. Free end portion 52 is provided with laterally projected portions 23 which extend from each side of free end portion 52**.

Lances 24 are provided on either side of vertical portion 19. Lances 24 are attached at one end to vertical section 19, proximate fixed end portion 54 of tongue 21. Opposite ends of lances 24 are curved inward toward wall portion 12 of base 11. A lance 25 is stamped from a section of vertical portion 19 and a section of base 11. Lance 25 is in alignment with tongue 21. A free end of lance 25 extends outward in the opposite direction from that of lances 24.

Terminal 10 is positioned on circuit board 50 such that holes 30 of circuit board 50 are aligned with contact pins 14. Terminal 10 is then forced downward onto circuit board 50 causing contact pins 14 to engage holes 30. As contact pins 14 are inserted legs 15*a*, 15*b* of pins 14 engage wall surfaces of holes 30 causing legs 15*a*, 15*b* to be forced inwardly thereby frictionally engaging the wall surfaces of holes 30. This results in terminal 20 being frictionally secured in place on circuit board 50.

With terminal 10 secured to circuit board 50, cylindrical female contact section 35 of the power supply is brought into engagement with male contact section 18 of terminal 10. Contact section 35 is inserted over tip portion 20 of section 18 such that projection 55 guides female contact section 35 over free end portion 52 of tongue 21. As insertion continues, an inner wall of section 35 is slid along arcuate contact surface 21*a* of tongue 21 and radiussed edges 19*a* of vertical portion 19. This causes tongue 21 to be biased toward vertical portion 19. Projected portions 23 of portion 52 engage inclined portion 17 preventing tongue 21 from further inward movement. Radiussed edges 19*a* and contact surface 21*a* enable section 35 to be more easily inserted and also provide an increased contact surface between section 18 and section 35.

Upon full insertion of female contact 35 over male contact 18, the inner wall of female contact 35 remains in contact with edges 19*a* of vertical portion 19 and contact 21*a* of tongue 21. The resilient characteristics of tongue 21 ensures that section 35 will engage edges 19*a* and surface 21*a* resulting in a positive electrical connection between male contact section 18 and female contact section 35, as shown in FIG. 3.

Figure 4:
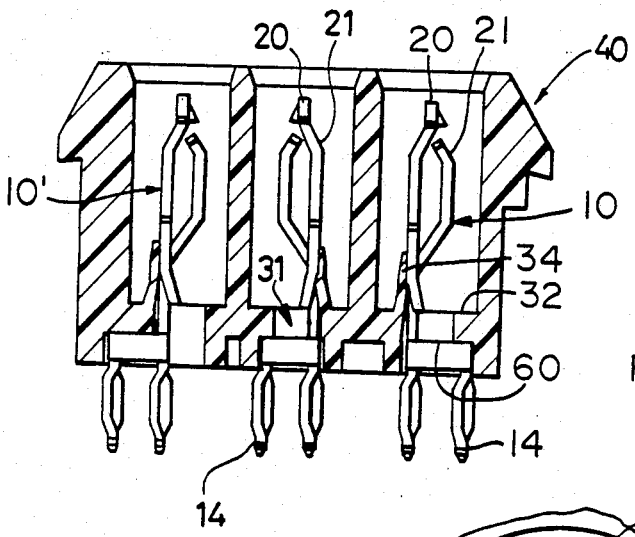
FIG. 4 is a cross-sectional view of an electrical connector of the present invention.
Figure 5:
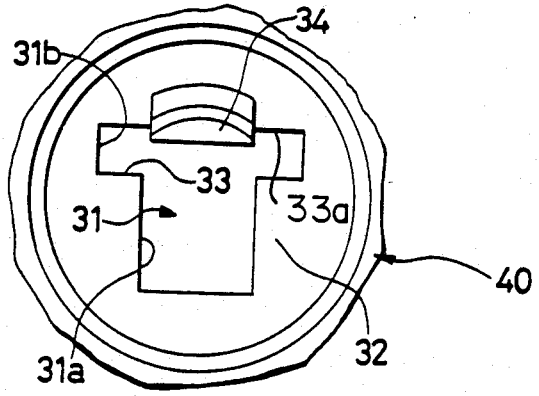
FIG. 5 is an enlarged fragmentary view showing a terminal insertion opening of the housing.

In case of a circuit board having a large current capacity requiring a plurality of terminals 10, it is advantageous to accommodate the plurality of terminals 10 in a housing to form a single electrical connector. For this purpose, each terminal 10 of the present invention is provided with lances 14 for retaining terminal 10 in housing 40. However, in order to align contact pins 14 of terminals 10 with holes 30 of circuit board 50 and maintain the required spacing of terminals 10 in housing 40, base 11 must be oriented in different directions as shown by terminals 10 and 10' of FIG. 4. Housing 40 may have three terminals 10 therein, as shown in FIG. 4, or any other number of terminals 10 as is required. Each terminal 10 is inserted into housing 40 from its lower end into a substantially T-shaped lower bottom opening 31 as shown in FIG. 5. As insertion occurs, tongue 21 passes through portion 31*a* while the rest of section 18 passes through portion 31*b* having a larger width than portion 31*a*.

Lances 24 engage side walls 33 of portion 31*b* as insertion occurs, forcing lances 24 to assume a stressed position. Upon full insertion, lances 24 move beyond side walls 33 of portion 31*b* allowing lances 24 to return to their original unstressed position in engagement with bottom wall 32. Simultaneously, the upper surface of base 11 engages a recess 60 of a bottom section of housing 40. Lance 25, however, remains in contact with side wall 33*a*. This positioning of lances 24 and base 11 with respect to bottom wall 32 prevents vertical movement of terminals 10 relative to housing 40.

A resilient support projection 34 is provided at each opening 31 of bottom wall 32. Each projection 34 engages a back surface of vertical portion 19 of terminal 10. Projections 34 and lances 25 cooperate to prevent horizontal movement of terminals 10 in housing 40.

Figure 6:
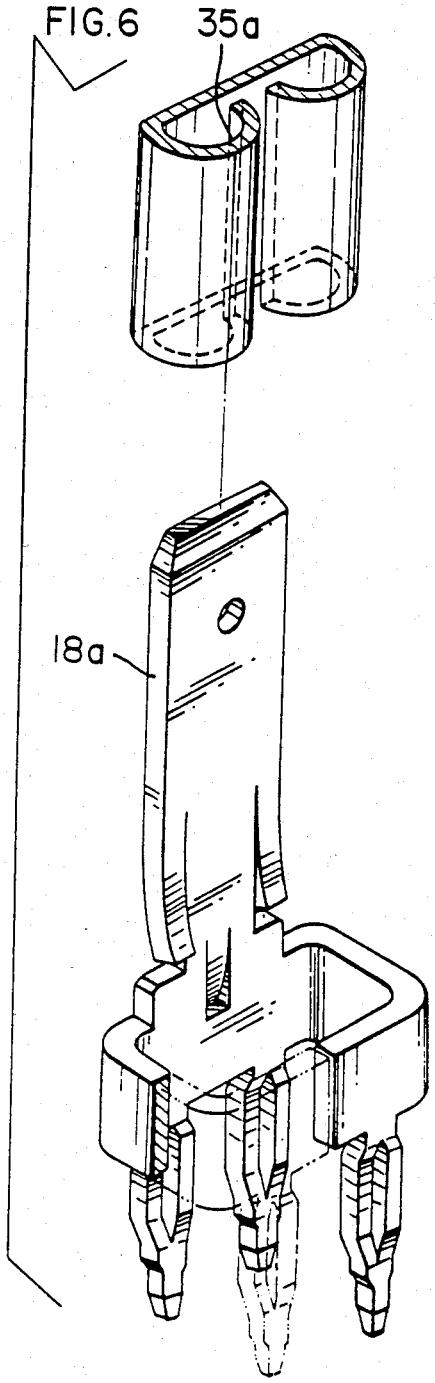
FIG. 6 is an alternative embodiment of the present invention having a flat wall contact section.
Figure 7:
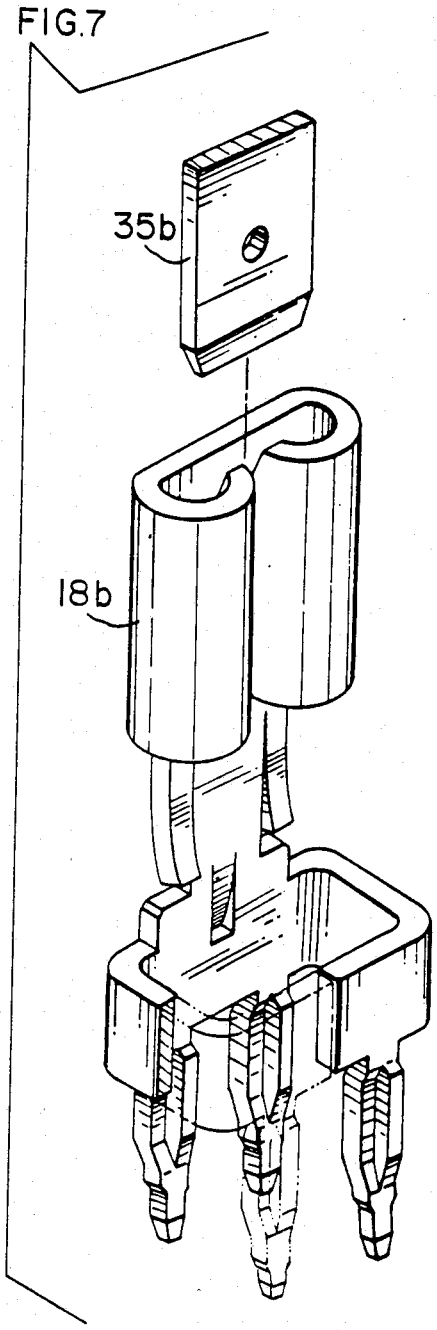
FIG. 7 is a second alternative embodiment showing a receptacle contact section.

Although there has been described in the aformentioned embodiment that the male contact of the terminal 10 is combined with the cylindrical female contact 35, the present invention is not limited to the male contact. FIGS. 6 and 7 show alternative embodiments depicting a male contact 18*a* and a female contact 18*b* to be combined with a female contact 35*a* and a male contact 35*b*, respectively.

We claim:

1. An electrical terminal for electrically connecting a power supply contact (35) to a circuit board (50), the terminal comprising a body section (11) having mounting pins (14) extending from walls (12, 13) of the body section (11) and a contact portion (18), the mounting pins (14) have compliant sections (15*a*, 15*b*) which frictionally engage holes (30) of the circuit board (50), the contact portion (18) connects the power supply (35) to the terminal, a positive electrical connection is thereby effected, the electrical terminal being characterized in that:

the body section (11) has a rectangular annular configuration which has the mounting pins (14) extending from bottom edges of the walls (12, 13), and the contact portion (18) extends from an upper edge of the wall (13) opposite the mounting pins (14), the contact portion (18) has a vertical section (19) which has a resilient tongue (21) extending therefrom, the vertical section (19) and the tongue (21) form a male contact portion and cooperate to be inserted into and resiliently engage a female power supply contact (35).

2. An electrical terminal set forth in claim 1 characterized in that the terminal is stamped and formed from a metal sheet having desirable conductive and spring characteristics.

3. An electrical terminal as set forth in claim 2 characterized in that the vertical section (19) has radiussed edges (19*a*) and the tongue (21) has an arcuate contact surface (21*a*) to allow for easier insertion of the power contact (35) onto the contact portion (18) as well as to provide increased contact area between the contact portion (18) and the power supply contact (35).

4. An electrical terminal as set forth in claim 3 characterized in that the tongue (21) is bent such that the arcuate contact surface (21*a*) is essentially parallel to the vertical section (19).

5. An electrical terminal as set forth in claim 4 characterized in that a free end of the tongue (21) has projections (23) normally extending therefrom to engage the vertical section (19), thereby preventing the tongue (21) from taking a permanent set due to overstress of the tongue (21).

6. An electrical terminal as set forth in claim 5 characterized in that a projection (55) is provided on the vertical section (19) proximate the free end of the tongue (21), the projection (55) guides the contact to an outside surface of the tongue (21) ensuring proper insertion of the contact (35).

7. An electrical terminal as set forth in claim 1 characterized in that upper lances (24) are provided adjacent the contact portion (18) enabling terminals (10) to be placed in a dielectric housing (40) having a bottom wall (32), the bottom wall (32) has an opening (31) which allows insertion of the terminals, such that lances (24) resiliently engage the bottom wall (32) as the body sections (11) engage recesses (60) of a bottom section of the housing (40), thereby preventing vertical movement of the terminals.

8. An electrical terminal as set forth in claim 7 characterized in that a lower lance (25) is provided on the terminals below the upper lances (25), the lance (25) contacts a side wall (33*a*) of opening (31) as a projection (34) of the housing (40) resiliently engages the contact portion (18), the cooperation of lance (25) and projection (34) prevents lateral movement of the terminal.

9. An electrical terminal for electrically connecting a power supply contact to a circuit board, the terminal comprising:

a rectangular annular body section having mounting pins and a contact portion extending therefrom;

the mounting pins extend from walls of the body section and have compliant sections which frictionally engage holes of the circuit board;

the contact portion extends from a respective wall of the body section, in the opposite direction as the mounting pins, the contact portion is provided to cooperate with the power supply contact; and resilient means extend from the contact portion of the terminal, the resilient means have a fixed end which is integral with the contact portion, and a free end which is positioned away from the contact portion.

10. An electrical terminal as recited in claim 9 wherein the contact portion is in the shape of a flat tab male contact portion for reception into a female power supply contact.

11. An electrical terminal as recited in claim 10 wherein the resilient means are lances which cooperate with a terminal housing to maintain the terminals in the housing.

12. An electrical terminal as recited in claim 9 wherein the contact portion is in the shape of a female contact portion for reception of a flat tab male power supply contact.

13. An electrical terminal as recited in claim 12 wherein the resilient means is a resilient tongue which extends from the contact portion, the tongue and the contact portion cooperate to be inserted into and resiliently engage a female power supply.

14. An electrical terminal as recited in claim 9 wherein the contact portion has a vertical section which has the resilient means extending therefrom.

15. An electrical terminal as recited in claim 14 wherein the resilient means is a resilient tongue, the resilient tongue and the vertical section form a male contact portion and cooperate to be inserted into and resiliently engage a power supply contact.

16. An electrical terminal as recited in claim 15 wherein the vertical section has radiussed edges and the tongue has an arcuate contact surface to allow for easier insertion of the power contact onto the contact portion as well as to provide increase contact area between the contact portion and the power supply contact.

* * * * *